US010566745B2

(12) United States Patent
Ronchi et al.

(10) Patent No.: US 10,566,745 B2
(45) Date of Patent: Feb. 18, 2020

(54) COMPACT INTERLOCKED ELECTRICAL SOCKET

(71) Applicant: PALAZZOLI S.P.A., Brescia (IT)

(72) Inventors: Marco Ronchi, Brescia (IT); Gianluigi Petrogalli, Leno (IT)

(73) Assignee: PALAZZOLI S.P.A., Brescia (IT)

( * ) Notice: Subject to any disclaimer, the term of this patent is extended or adjusted under 35 U.S.C. 154(b) by 0 days.

(21) Appl. No.: 15/773,341

(22) PCT Filed: May 19, 2017

(86) PCT No.: PCT/EP2017/000604

§ 371 (c)(1),
(2) Date: May 3, 2018

(87) PCT Pub. No.: WO2017/198338

PCT Pub. Date: Nov. 23, 2017

(65) Prior Publication Data

US 2019/0067887 A1 Feb. 28, 2019

(30) Foreign Application Priority Data

May 19, 2016 (IT) ..... 102016000051784

(51) Int. Cl.
*H01R 29/00* (2006.01)
*H01R 13/703* (2006.01)
*H01R 13/625* (2006.01)

(52) U.S. Cl.
CPC ..... *H01R 13/7032* (2013.01); *H01R 13/625* (2013.01)

(58) Field of Classification Search
CPC ..... H01R 2103/00; H01R 13/6275; H01R 13/20; H01R 13/518; H01R 23/7073; H01R 24/58; H01R 13/7036
(Continued)

(56) References Cited

U.S. PATENT DOCUMENTS 2,957,955 A 10/1960 Sleeter
5,277,602 A * 1/1994 Yi ..... H01R 13/7036 439/138

(Continued)

FOREIGN PATENT DOCUMENTS

CN 101685933 3/2010
CN 203690653 7/2014

(Continued)

*Primary Examiner* — Thanh Tam T Le
(74) *Attorney, Agent, or Firm* — Duane Morris LLP; Gregory M. Lefkowitz; Jason M. Nolan

(57) ABSTRACT

A compact interlocked electrical socket, including a containment body provided with a plurality of receptacles adapted to receive respective pins of a plug is provided. Each receptacle is electrically connected to a connector by contacts that are movable between a closed contact position, which corresponds to the closure of the circuit, and an open contact position, which corresponds to the opening of the circuit. The closed contact position allows an electrical connection between the receptacle and the connector. The open contact position breaks the electrical connection between the receptacle and the connector. The plug can be mechanically locked in the closed contact position. The breaker locks can be mechanically locked in the open contact position when the plug is not inserted in the socket.

10 Claims, 7 Drawing Sheets

(58) Field of Classification Search
USPC ..... 439/188, 345, 346, 540.1, 541.5, 668; 200/51.09, 51.1
See application file for complete search history.

(56) References Cited

U.S. PATENT DOCUMENTS

| | | | | |
|---|---|---|---|---|
| 6,039,594 | A | 3/2000 | Zuppa | |
| 6,227,905 | B1 * | 5/2001 | Tsai | H01R 13/658 439/541.5 |
| 6,382,990 | B1 * | 5/2002 | Marechal | H01R 13/527 439/138 |
| 6,431,888 | B1 * | 8/2002 | Crestin | H01R 13/4538 439/141 |
| 7,041,918 | B1 * | 5/2006 | Wu | H01R 13/703 200/51.09 |
| 7,445,472 | B1 * | 11/2008 | Huang | H01R 13/4536 439/138 |
| 7,537,468 | B1 * | 5/2009 | Huang | H01R 13/4536 439/135 |
| 7,641,489 | B1 * | 1/2010 | Hsu | H01R 13/4538 200/51.09 |
| 7,740,499 | B1 | 6/2010 | Willey et al. | |
| 7,931,484 | B2 * | 4/2011 | Chen | H01R 13/20 439/188 |
| 8,496,491 | B2 * | 7/2013 | Baek | H01R 13/71 200/51.09 |
| 8,772,654 | B2 * | 7/2014 | Tziviskos | H01R 13/7033 200/51.09 |
| 9,252,539 | B2 * | 2/2016 | Condo | H01R 13/6456 |
| 9,819,127 | B2 * | 11/2017 | Condo | H01R 13/6456 |
| 2014/0127926 | A1 | 5/2014 | Condo et al. | |
| 2014/0127933 | A1 | 5/2014 | Franke et al. | |

FOREIGN PATENT DOCUMENTS

| | | |
|---|---|---|
| EP | 224149 | 10/2010 |
| GB | 208081 | 12/1923 |

* cited by examiner

COMPACT INTERLOCKED ELECTRICAL SOCKET

CROSS-REFERENCE TO RELATED APPLICATIONS

This application is a § 371 national stage entry of International Application No. PCT/EP2017/000604, filed May 19, 2017, which claims priority to Italian Patent Application No. 102016000051784, filed May 19, 2016, the entire contents of which are incorporated herein by reference.

FIELD OF INVENTION

The present invention relates to a compact interlocked electrical socket.

The present invention relates in particular to an industrial socket that is compliant with the EN60309-1 EN60309-2 standard, which is provided with a circuit breaker and a mechanical interlock, in compliance with the EN 60309-4 standard; however, it is evident to the person skilled in the art that the present invention can be applied advantageously also to sockets provided according to other standards or outside of the standards.

BACKGROUND

As is known, in order to ensure the safety of the operators and the integrity of all apparatuses with high absorption levels, an interlocked socket incorporates a locking device, of a mechanical or electrical type or a combination thereof, which is connected to an electric circuit breaker, which is constituted very often by a rotary switching apparatus, in order to ensure that the plug cannot be inserted or removed in the presence of voltage.

Conventional interlocked sockets generally have considerably larger dimensions than simple sockets having similar electrical characteristics, in order to be able to accommodate the breaker of the electric circuit, the member for actuating it and the device for the mechanical locking of the plug.

GB208081 discloses a plug connector combined with an electric switch. Two contact carrying discs are coupled together on inserting the plug which latter is turned to close the circuit and retained in this position by a detent engaging a pin of the plug; upon withdrawing the plug the lower disc is released and opens the circuit and the detent and upper disc are then released in turn. The plug has three pins, one longer than the others. The pins enter bushed holes in an upper disc carrying contact arms in connection with the bushes and normally pressed into two spring jaws on a second disc. The pin enters a hole in the disc and when the plug is turned both discs are carried around so that contact blades connected to the contact jaws on the disc are inserted into terminal jaws on the base and close the circuit. Springs controlling each disc are strained in this movement and a spring controlled detent on a part and arranged between the discs engages the pin and locks it and the discs against rotation.

BRIEF SUMMARY OF THE INVENTION

The aim of the present invention is to provide an interlocked electrical socket that has an extremely more compact structure compared to the interlocked sockets of the prior art.

Within the scope of this aim, an object of the invention is to provide a compact interlocked electrical socket that can be used as an inline socket.

Another object of the invention is to provide a compact interlocked electrical socket that can be mounted on a wall or on an electrical panel, occupying an extremely reduced space with respect to a conventional interlocked socket.

A further object of the present invention is to provide a compact interlocked electrical socket that is capable of complying with the most widespread rules and standards.

Another object is to provide a compact interlocked electrical socket that is easy and simple to use.

Another object of the present invention is to provide a socket which, by virtue of its particular constructive characteristics, is capable of giving the greatest assurances of reliability and safety in use.

Another object of the present invention is to provide a structure that can be provided easily by using commonly commercially available elements and materials and is furthermore competitive from an economic standpoint.

This aim and these and other objects which will become better apparent hereinafter are achieved by a compact interlocked electrical socket as claimed in the appended claims.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION OF THE INVENTION

Figure 1:
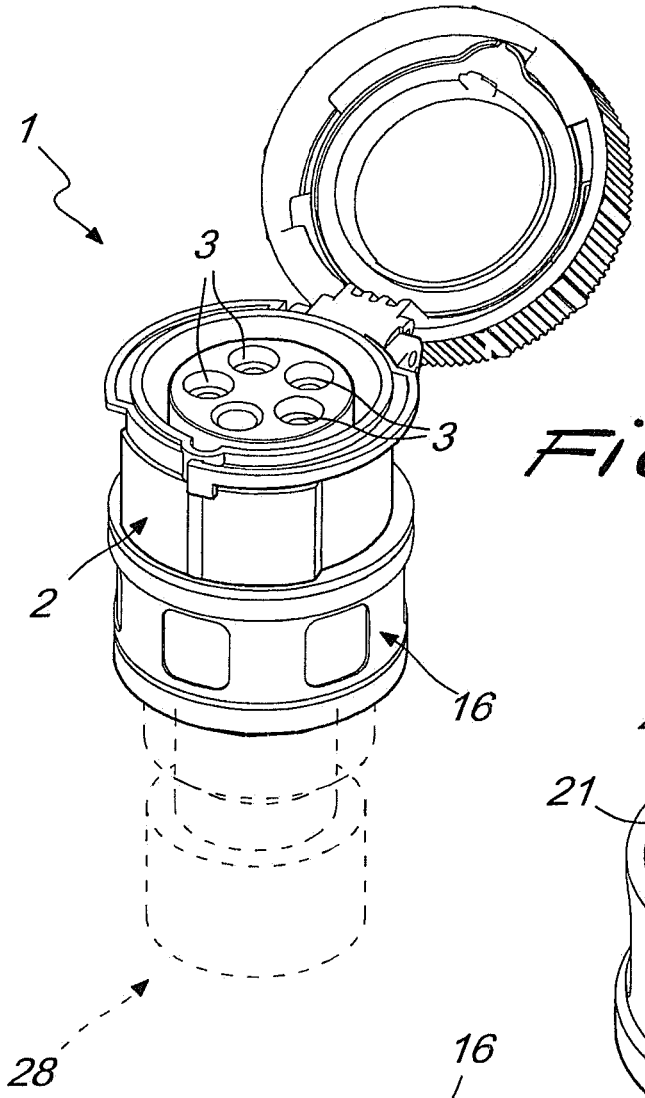
FIG. 1 is a perspective view of the compact interlocked electrical socket to according to the present invention.
Figure 2:
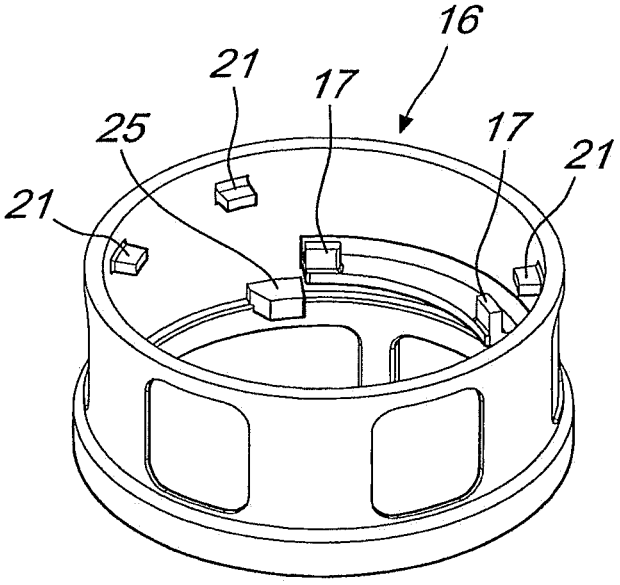
FIG. 2 is a perspective view of the switching member of the breaker.
Figure 3:
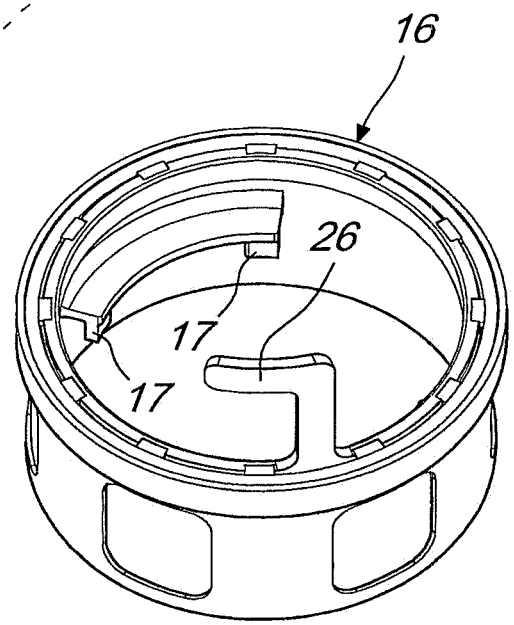
FIG. 3 is a perspective view of the opposite side, with respect to the preceding figure, of the switching member.
Figure 4:
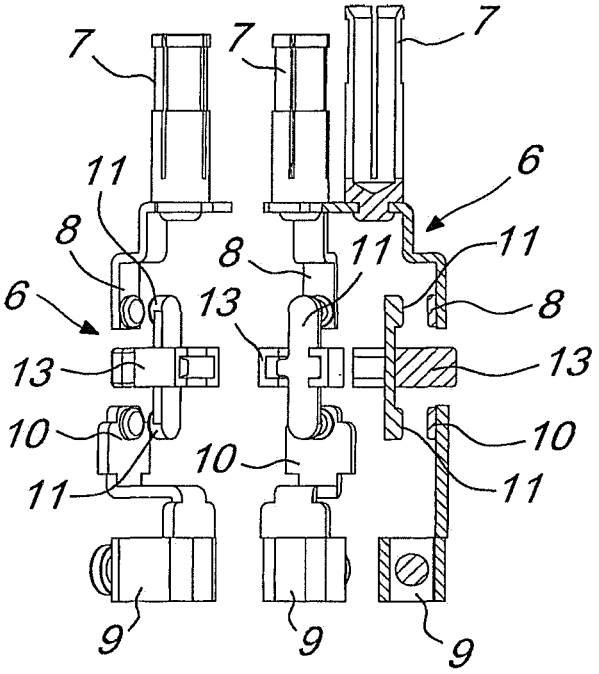
FIG. 4 is a perspective view of three terminal-receptacle contact chains, shown in cross-section at the neutral contact chain.
Figure 5:
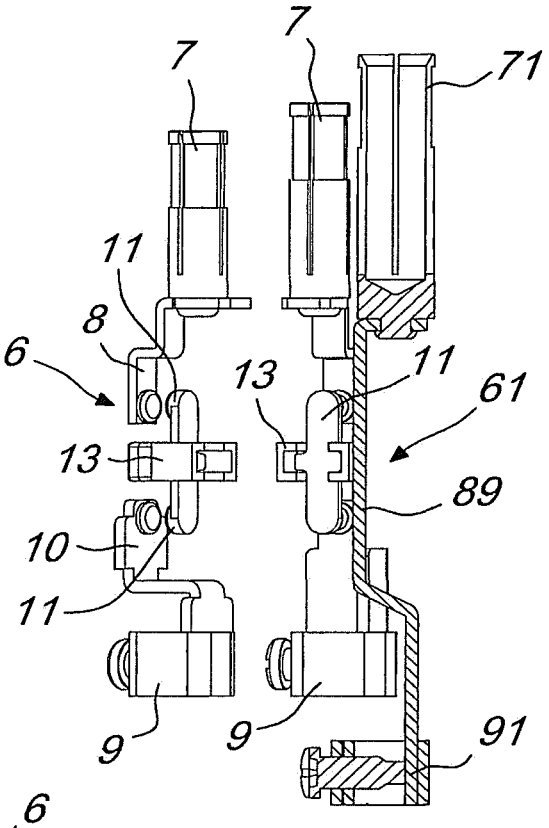
FIG. 5 is another perspective view of three terminal-receptacle contact chains, shown in cross-section at the ground contact chain.
Figure 6:
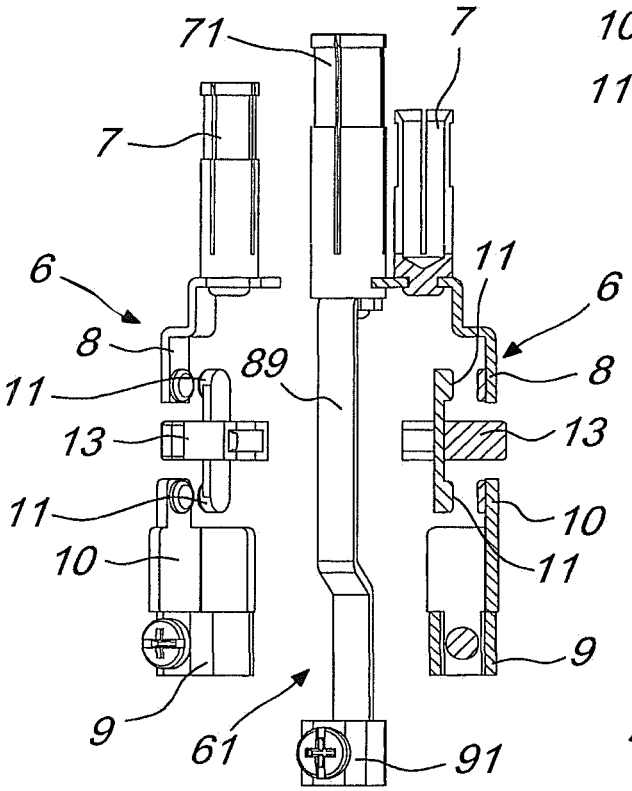
FIG. 6 is a perspective view of three terminal-receptacle contact chains, shown in cross-section at the phase contact chain.

With reference to the cited figures, the compact interlocked electrical socket according to the invention, globally designated by the reference numeral 1, includes a containment body 2 having a plurality of seats 3 for respective receptacles adapted to receive the pins of a plug, which is not shown in the figures.

The seats 3 are provided in a cylindrical part 4 which is accommodated in the containment body 2 in which a central body 5 is also engaged which acts as a support for a plurality of contact chains 6.

Each contact chain 6 includes a receptacle 7, having a corresponding downstream fixed contact 8, and a terminal 9, having a respective upstream fixed contact 10.

The fixed contacts 8 and 10 are placed in mutual electrical contact by means of a movable contact 11.

The socket also includes a contact chain 61 for ground connection, which is constituted by a receptacle 71 which is connected to a terminal 91 by means of a blade 89 without discontinuity.

In each contact chain 6, the upstream fixed context 10 is connected to the power source and the downstream fixed contact 8 is connected to the load.

The movable contact 11 is pressed by a spring 12 in contrast with a movable mechanical device and can be brought into contact alternately with the fixed contacts 8 and 10 or spaced from them.

In the embodiment shown in the figures, in each contact chain 6, the upstream fixed contact 10 is connected to the respective terminal 9, to which a power supply cable, not shown in the figures, is wired, while the downstream contact 8 is connected to the receptacle 7, i.e., to the female contact of the socket 1.

The upstream contacts 10 and the downstream contacts 8 are arranged along a circumference.

The poles can be two, three or four, in addition to the ground, which is a through ground and is not disconnected.

The contact chains 6 of the various poles allow an advantageous execution of the closure and opening of the contacts by means of the movement of the movable contacts 11.

Each movable contact 11 slides in a seat which makes the movable contact 11 move exclusively in a radial direction.

Each movable contact 11 is accommodated in a contact holder 13, which has the triple purpose of sliding along the seat, accommodating the spring 12 and sliding against a cam 14.

The movable contact 11 is kept pressed by the spring 12, which pushes it toward the fixed contacts 8 and 10.

The contrast spring 12 is calibrated so that when the contact is closed it provides the correct contact pressure between the movable contacts 11 and each fixed contact 8, 10.

The opening operation is performed by the cams 14 provided on a cam disk 15.

Figure 8:
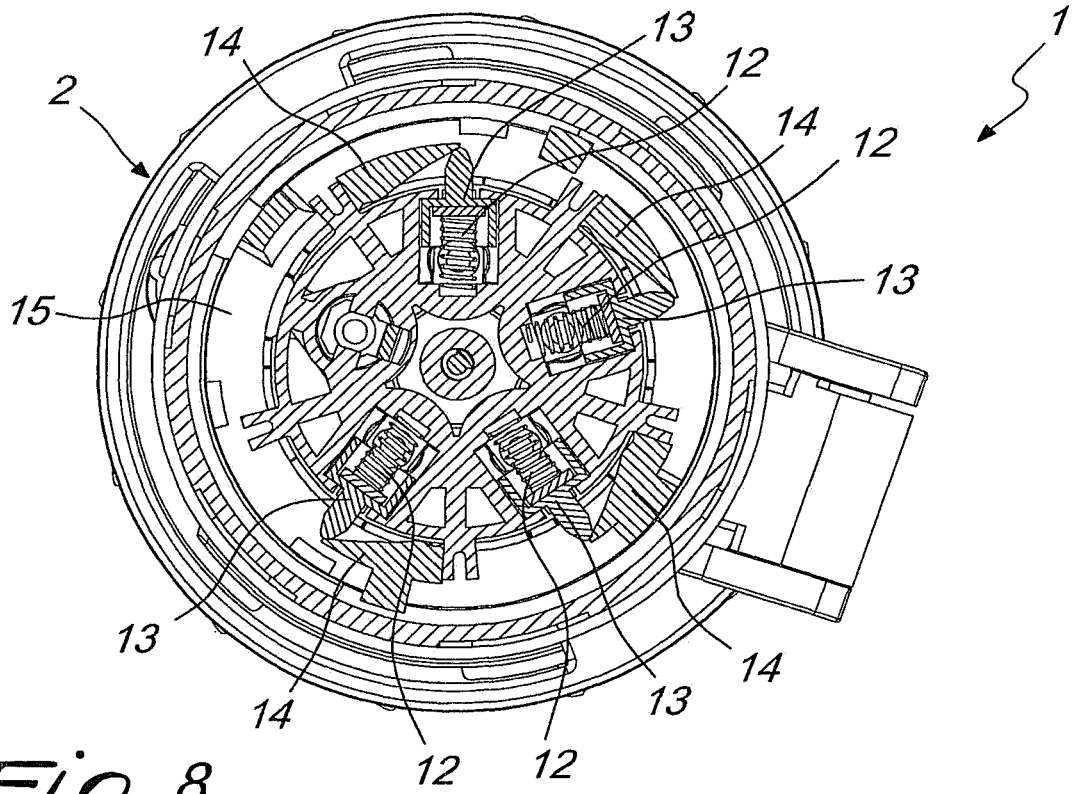
FIG. 8 is a transverse sectional plan view of the socket in the closed breaker position.
Figure 9:
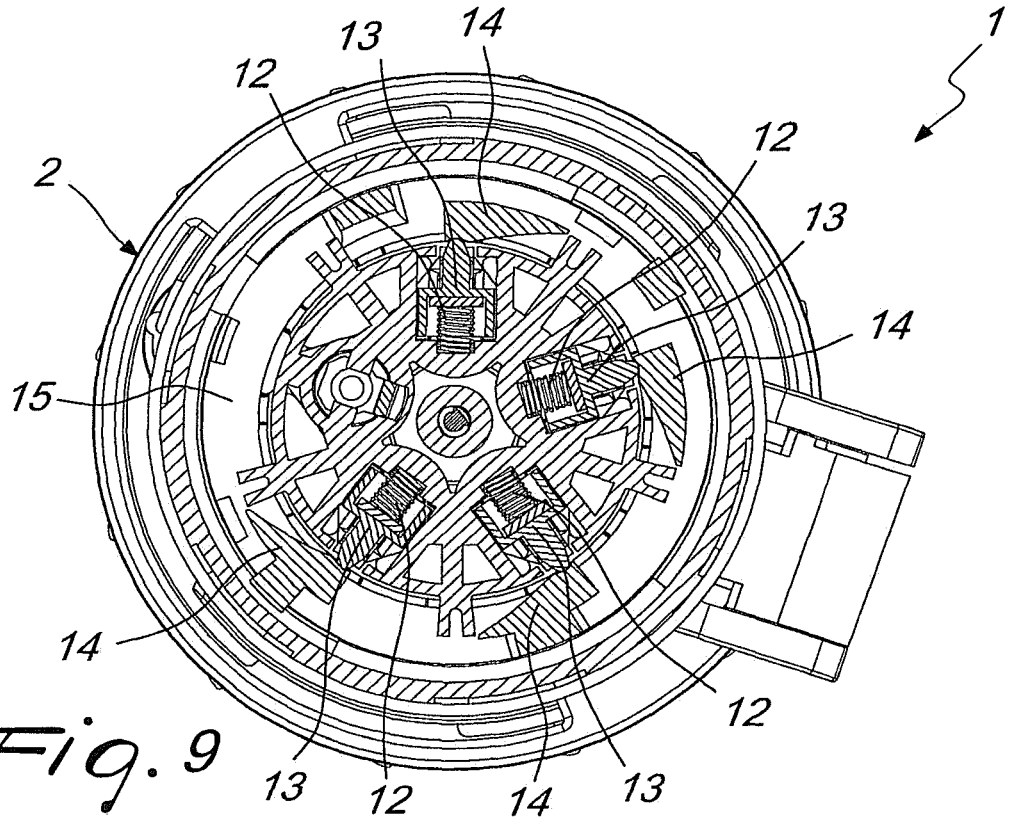
FIG. 9 is a view, similar to the preceding one, of the socket in the open breaker position.

The cam disk 15 rotates through a preset angle. The rotation of the cam disk 15, which is limited by stroke limiters constituted by mechanical abutments, causes the back and forth translation of each contact holder 13 and with it of the respective movable contact 11. The term "forward" means that the FIG. 8 shows the cam disk 15 in the closed breaker position, in which the contacts 11 are at the outward stroke limit; FIG. 9 shows the open breaker position, wherein the contacts 11 are at the stroke limit, toward the center.

The rotary motion for the actuation of the cam disk 15 is transmitted by an external member which is constituted by a switching ring 16 which is held and rotated.

The switching ring 16 contributes to constitute the enclosure of the socket and ensures the hermetic tightness, "IP rating", with an appropriate gasket system.

Transmission of the motion between the switching ring 16, which is actuated by hand, and the internal cam disk 15 can occur in two manners.

The simplest manner is that the two components are mutually integrally coupled; in this case the motion of the ring coincides with the motion of the internal cams.

A second manner, which is more advantageous from a functional standpoint, allows a so-called "independent switching" of the breaker in which there is no relation between the speed of the external switching, imposed by the hand, and the speed of movement of the contacts.

This second manner is the preferred embodiment of the present invention.

The switching ring 16 is provided with pusher members 17 which, when the ring rotates, begin to compress two switching springs 18 which are accommodated in the cam disk 15, which is initially coupled and unable to rotate.

The rotation of the switching ring 16, in view of the constraint of the cam disk 15, compresses progressively the switching springs 18.

The rotation of the cam disk 15 is prevented by a system of lugs 19, which engage slots 20 provided in the central body 5, which is a fixed part of the socket 1.

A pair constituted by a lug 19 and a slot 20 locks the cam disk 15 in a "0" position, i.e., in the open contact position, while the second pair constituted by the lug 19 and the slot 20 blocks the cam disk 15 in the "1" position, i.e., in the closed contact position.

The rotation of the switching ring 16, in the absence of the rotation of the cam disk 15, produces a progressive compression of the switching springs 18 until, when a given rotation angle has been reached, brackets 21 formed within the switching ring 12 extract the lug 19 of the cam disk 15 from the corresponding slot 20.

At this point the cam disk 15, which is no longer constrained and pressed by the switching springs 18 at their point of maximum compression, rotates at a speed that is determined by forces and frictions but not by the hand of the operator, the movement of which has by now ended.

Pushed by the switching springs 18, the cam disk 15 rotates rapidly until it arrives at a mechanical stop.

The rotation of the cam disk 15, as described above, actuates the movable contacts 11 by means of the cams 14.

In its final position, the second lug 19 engages the second slot 20. This engagement prevents the rotation of the cam disk 15 in the opposite direction when one proceeds with the reverse switching.

The opening and closing switching is perfectly symmetrical.

Figure 10:
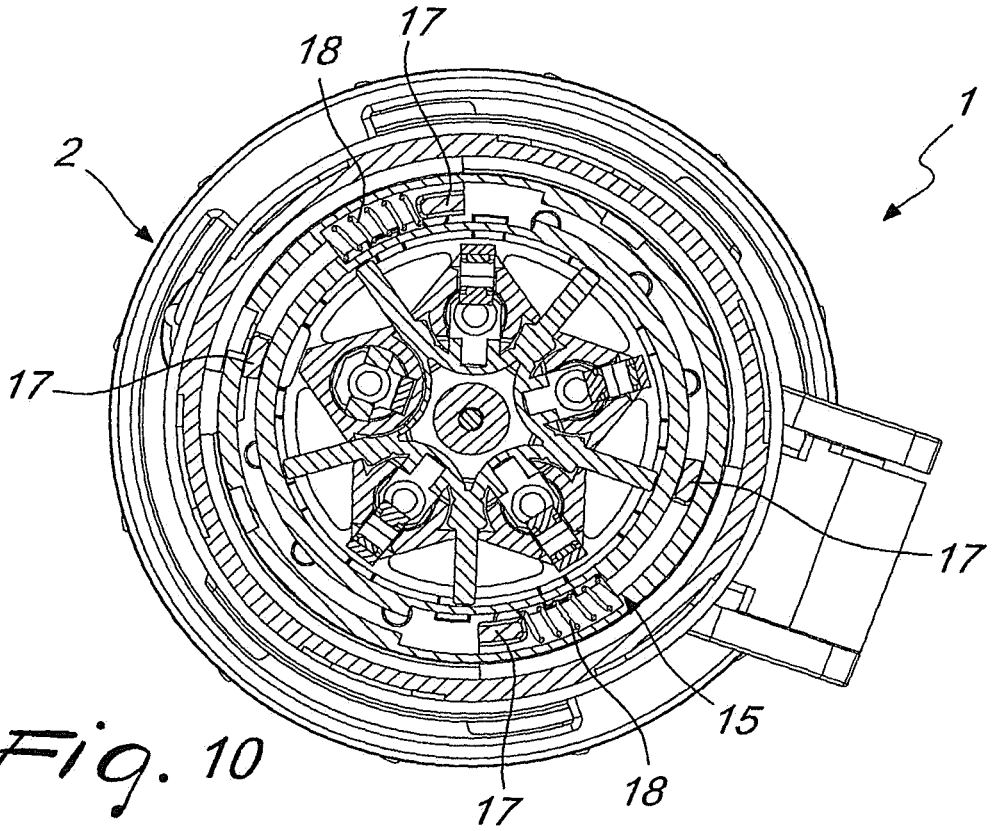
FIG. 10 is a plan view, taken in transverse cross-section in the cam disk region, which shows the switching springs in the compressed position.
Figure 11:
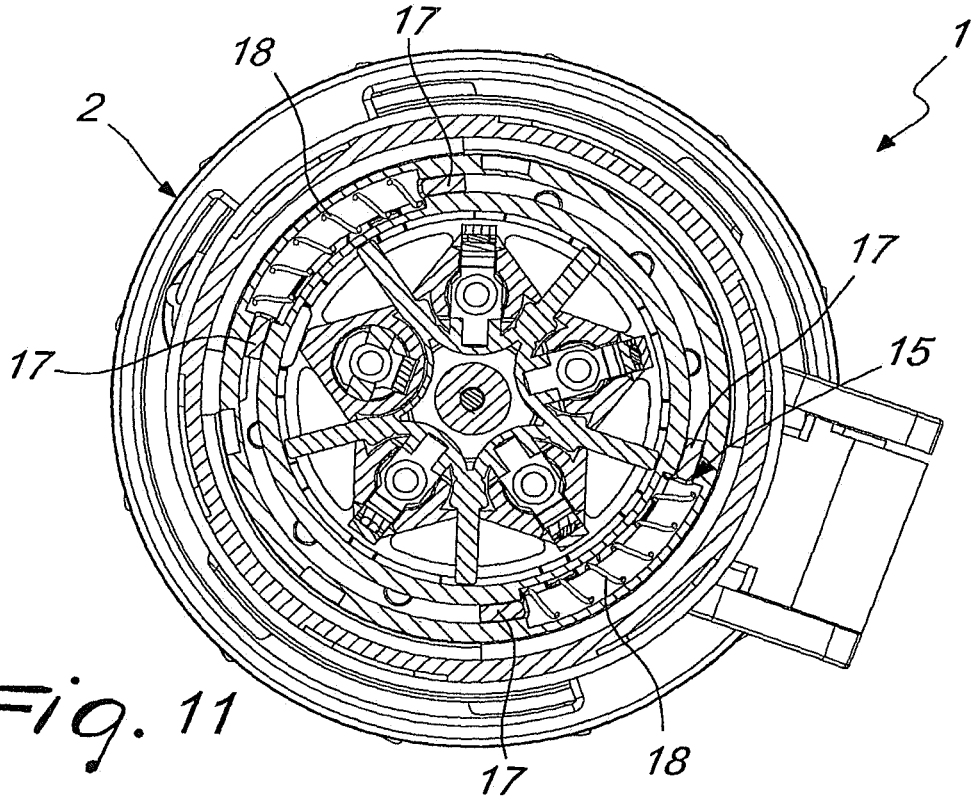
FIG. 11 is a view, similar to the preceding one, of the switching springs in the extended position.
Figure 12:
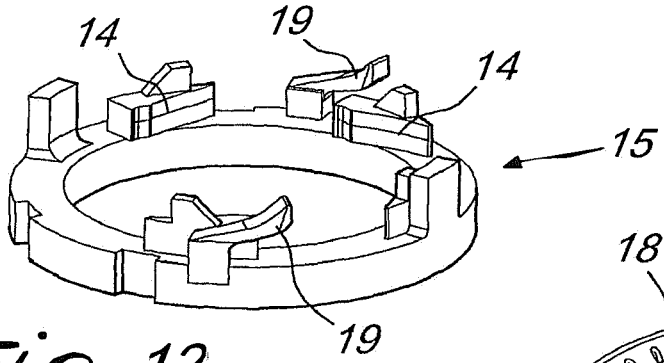
FIG. 12 is a perspective view of the cam disk.
Figure 13:
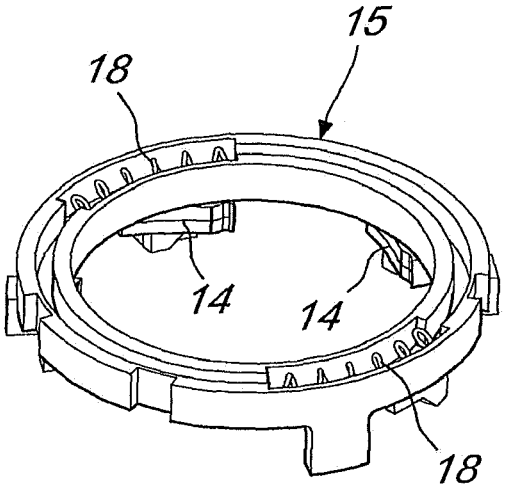
FIG. 13 is a perspective view of the opposite side, with respect to the preceding figure, of the cam disk.
Figure 14:
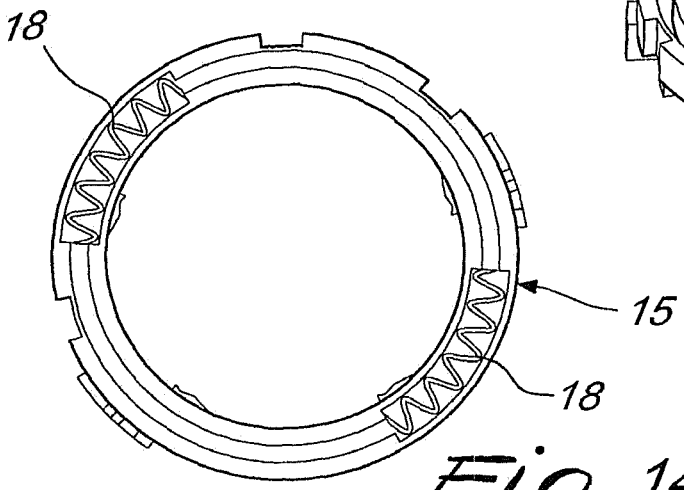
FIG. 14 is a plan view of the cam disk.
Figure 15:
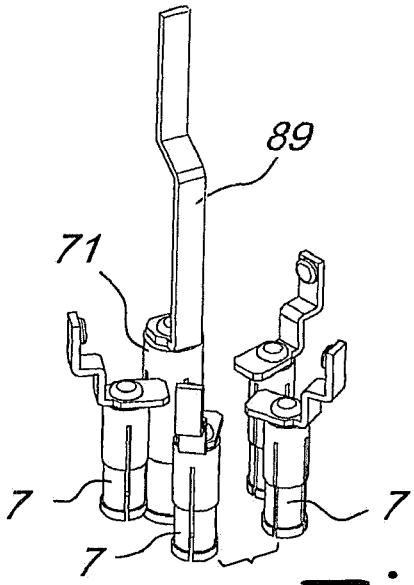
FIG. 15 is a perspective view showing five receptacles and the respective fixed contacts.
Figure 16:
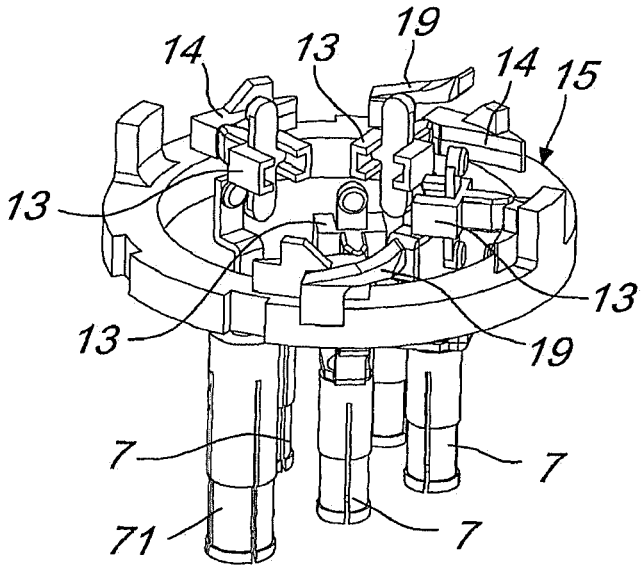
FIG. 16 is a schematic perspective view of the arrangement of the five receptacles and of the respective fixed contacts of the preceding figure with respect to the cam disk.
Figure 17:
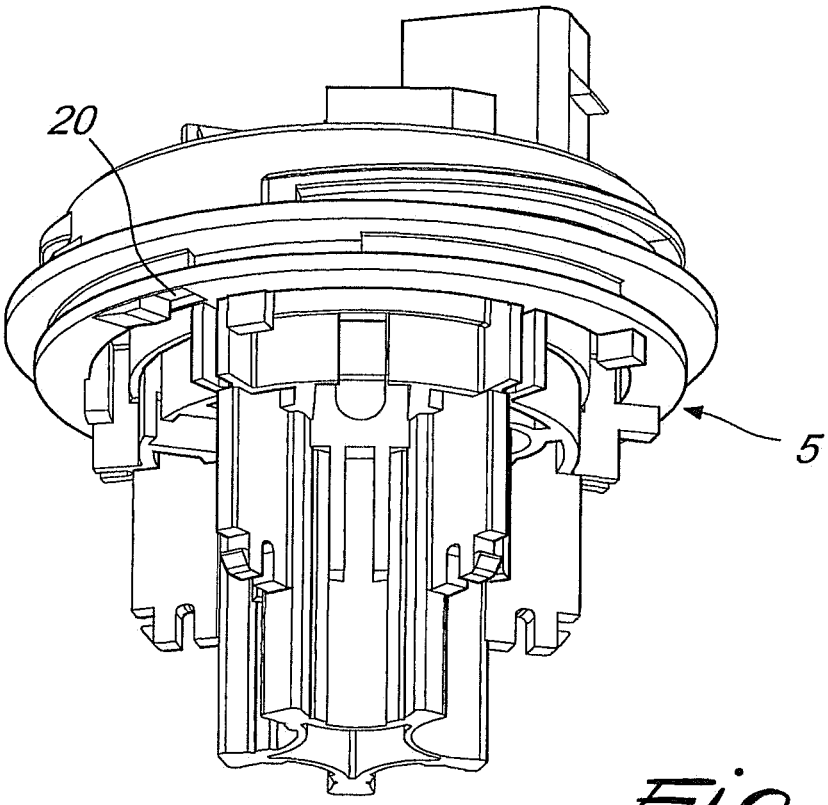
FIG. 17 is a perspective view of the central body of the socket.
Figure 18:
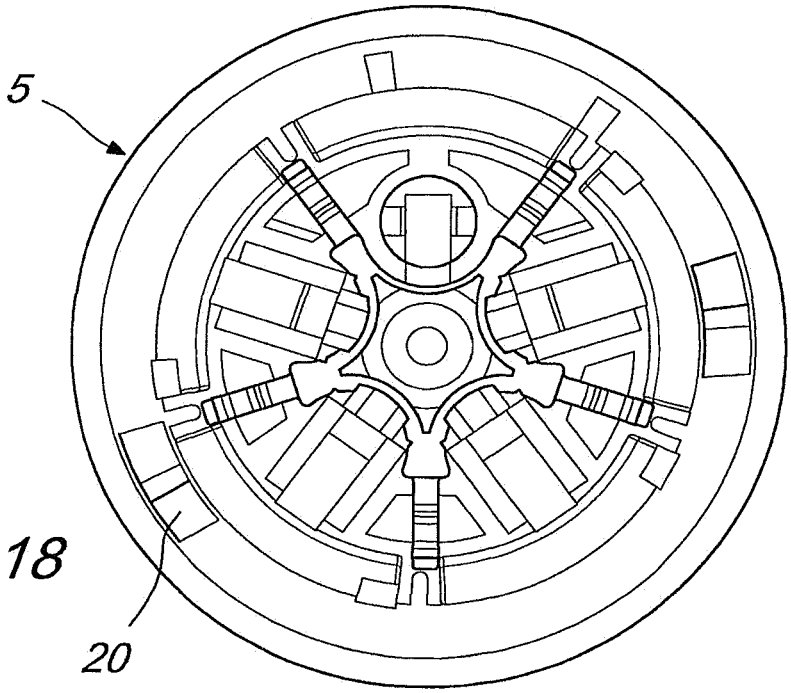
FIG. 18 is a plan view of the central body of the socket.

FIGS. 10 and 11 show the switching springs 18 in the rest position/maximum extension position (FIG. 11) and in the compression position (FIG. 10).

According to the present invention, the socket 1 also has a mechanical socket/plug interlock, which has the dual function of preventing the actuation of the breaker in ON mode, if the plug is not inserted, and of preventing the extraction of the plug if the breaker is in the ON mode.

As in conventional interlocked sockets, the interlock system makes the following sequences mandatory: inserting the plug and then operating the breaker to the ON position, in order to perform the electrical connection, and operating the breaker in the OFF position and extracting the pin, in order to break the electrical connection.

The interlock system includes a slider 22 with a return spring 23 which is arranged in the interspace between the cylindrical part 4 and the enclosure 2.

When the plug is extracted, the slider 22 is in the position in which the return spring 23 is extended.

Figure 7:
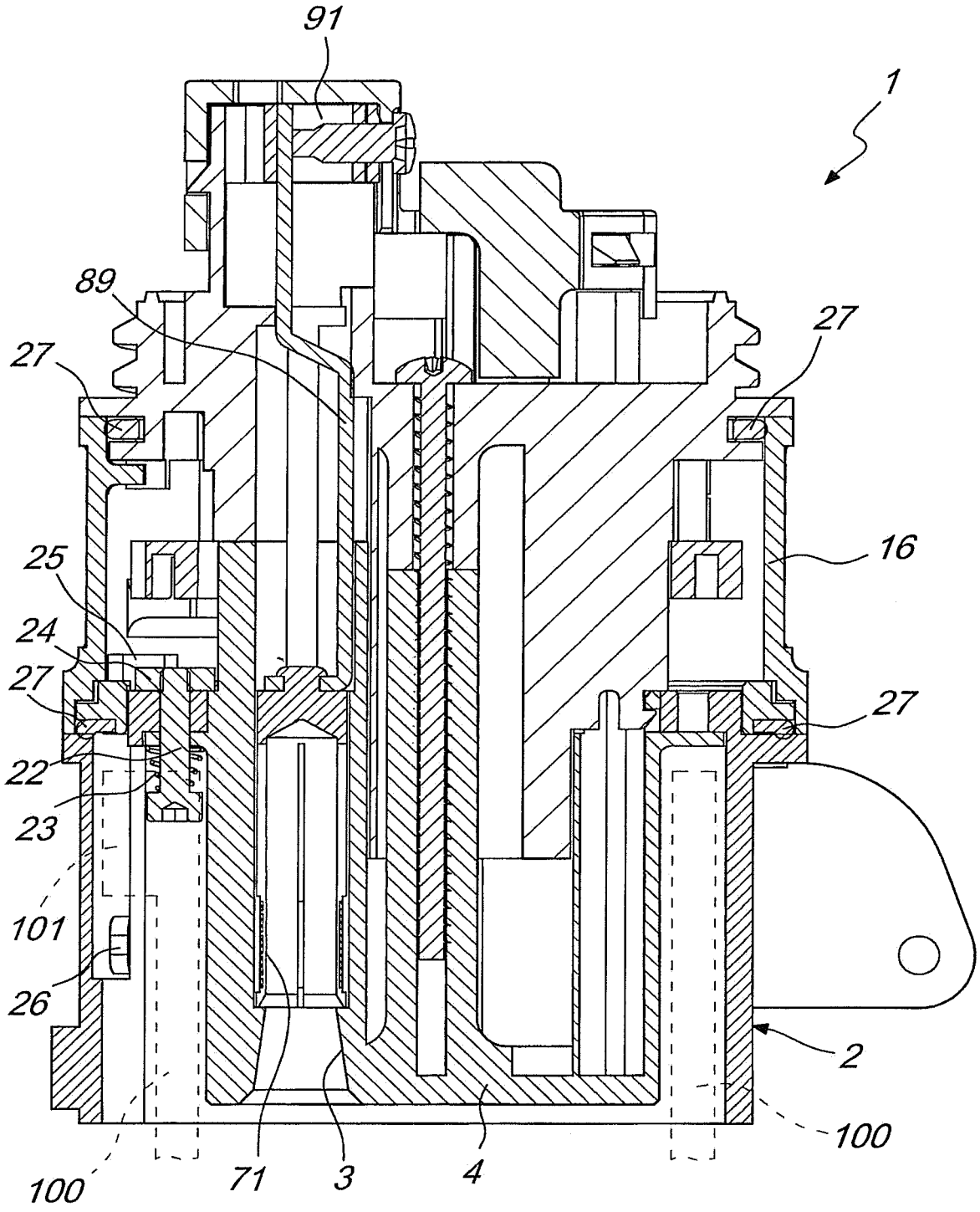
FIG. 7 is a longitudinally sectional view of the socket.

As can be seen in FIG. 7, in this position the internal head 24 of the slider 22 engages a contrast member 25 of the switching ring 16, preventing its rotation and consequently the actuation of the breaker to the ON mode.

When the plug is inserted, its annular part 100, shown in dashes, presses against the slider 22, making it shift and compressing the return spring 23. Once the shifting has been completed, the internal head 25 disengages from the contrast member 25 of the switching ring 16, allowing its rotation and consequently the actuation of the breaker to the ON mode.

The interlock system also includes a hook 26, which is formed in the switching ring 16 and is adapted to interact with a lug 101 provided on the plug, which has standardized dimensions and positions.

As described above, when the plug is inserted it is possible to rotate the switching ring 16 to the breaker ON position. This rotation moves the hook 26 to a position that traps the lug 101, as visible in FIG. 7.

The switching ring 16 contributes to form the enclosure of the socket, which must protect the electrical contacts from the penetration of liquids and solids ("IP" rating). This function is obtained by means of gaskets 27 which are arranged between the switching ring 16 and the core of the socket.

In the use of the interlocked socket as an inline socket, the socket assembly is associated with a grip 28, shown with broken lines in FIG. 1.

The socket assembly, without the grip 28, can be mounted on a wall or on an electrical panel by means of adapted systems of flanges and sliders.

In practice it has been found that the invention achieves the intended aims and objects, an interlocked electrical socket having being provided which is extremely more compact than traditional interlocked sockets and at the same time is easy to use.

This application claims the priority of Italian Patent Application No. UA2016A003614 (corresponding to No. 102016000051784), filed on May 19, 2016, the subject matter of which is incorporated herein by reference.

The invention claimed is:

1. A compact interlocked electrical socket comprising:

a containment body provided with a plurality of receptacles adapted to receive respective pins of a plug;

wherein each of said receptacles is electrically connected to a connector by means of a movable contact that moves between a closed contact position and an open contact position; and wherein said closed contact position allows an electrical connection between said receptacle and said connector, and said open contact position breaks the electrical connection between said receptacle and said connector;

a plug lock member configured to mechanically lock said plug in said socket in said closed contact position, a breaker lock member configured to mechanically lock said movable contact in said open contact position, when said plug is not inserted in said socket;

an actuation member that simultaneously actuates said plug lock member and said breaker lock member that operate said movable contact, a plurality of contact chains, one for each pole of said socket;

wherein each contact chain comprises a receptacle provided with a downstream fixed contact, and a terminal that is provided with a respective upstream fixed contact;

wherein said upstream and downstream fixed contacts are configured to be in mutual electrical contact by means of the movable contact; and wherein said upstream fixed contact is connected to an electric power source and said downstream fixed contact is connected to an electric load, wherein each of said movable contact is pressed by a contrast spring with a mobile mechanical device and can be alternately brought into contact with said fixed contacts or moved away from the fixed contacts;

wherein each movable contact is configured to slide in a seat that only allows the moveable contact to move in a radial direction;

wherein each movable contact is accommodated in a contact holder that slides in said seat and accommodates said contrast spring;

wherein said contact holder is slidable on a respective cam of a plurality of cams formed on a cam disk;

wherein said cam disk is rotatable through an angle that is defined by stroke limiters constituted by mechanical abutments; and wherein the rotation of said cam disk causes each contact holder and of the respective movable contact to slide in said radial direction.

2. The electrical socket according to claim 1, comprising a contact chain for a ground connection constituted by a receptacle connected to a terminal by means of an unbroken conductor.

3. The electrical socket according to claim 1, wherein each of said upstream contacts and each of said downstream contacts are arranged radially along a circumference with respect to other upstream contacts and downstream contacts, respectively.

4. The electrical socket according to claim 1, wherein the rotary motion of said cam disk is transmitted by said actuation member constituted by a switching ring which is gripped and rotated;

wherein said switching ring contributes to form a casing of said socket, ensuring a hermetic seal.

5. The electrical socket according to claim 4, wherein said switching ring transmits motion to said cam disk being integral with the switching ring.

6. The electrical socket according to claim 4, wherein said switching ring transmits motion to said cam disk through an independent switching, wherein in independent switching there is no relation between a speed of manual actuation of said switching ring and a speed of the movement of the movable contacts;

wherein said switching ring comprises pusher members which, when said switching ring turns, begin to compress two switching springs accommodated in said cam disk, which is initially constrained and cannot rotate;

wherein said rotation of said switching ring, because of the constraint of the cam disk, progressively compresses said switching springs;

wherein the rotation of the cam disk is prevented by a system of lugs engage slots formed in a central body of said socket;

wherein a first lug and slot pair locks the cam disk in the open contact position, and a second lug and slot pair locks the cam disk in the closed contact position;

wherein the rotation of the switching ring, in the absence of the rotation of the cam disk, causes a progressive compression of the switching springs, and upon reaching a predetermined rotation angle, brackets form inside the switching ring, wherein said brackets extract the lugs of the cam disk from the corresponding slot;

wherein said cam disk, when not constrained and pressed by the switching springs at a maximum compression point, rotates at a speed that is determined by forces and frictions but not by manual action on said switching ring, whose movement has by now ended;

wherein the cam disk, when pushed by the switching springs, rotates rapidly until it reaches a mechanical abutment;

wherein the rotation of the cam disk actuates the movable contacts by means of said cams; and wherein in its end position, the second lug engages the second slot; and said engagement prevents the rotation of the cam disk in the opposite direction when performing the reverse switching.

7. The electrical socket according to claim 4, further comprising a slider and a return spring;

wherein the slider and return spring are arranged in an interspace between a cylindrical central part of the socket and an outer enclosure, wherein the interspace is adapted to receive a portion of said plug;

wherein when the plug is not inserted, said slider is in a position in which the return spring is in an extended position, and an inner head of the slider engages a contrast member of said switching ring, preventing its rotation and consequently the actuation of the breaker means;

wherein when the plug is inserted, an annular part of the plug presses against the slider, making it shift and compress the return spring; and wherein when insertion has been completed, the inner head of the slider disengages from said contrast member of the switching ring, allowing its rotation and consequently the actuation of the breaker means.

8. The electrical socket according to claim 7, further comprising a hook formed in the switching ring, wherein the hook is adapted to interact with a lug provided on said plug;

wherein when the plug is inserted, said switching ring can be rotated to the closed contact position; and the rotation moves the hook to a position that traps the lug and prevents extraction of the plug.

9. The electrical socket according to claim 1, wherein the plug lock member is in compliance with EN60309-4.

10. The electrical socket according to claim 1, wherein the electrical socket is in compliance with EN60309-1 and/or EN60309-2.

* * * * *